US005261342A

United States Patent [19]

Griggs

[11] Patent Number: 5,261,342

[45] Date of Patent: Nov. 16, 1993

[54] HULL COVERING SYSTEM

[76] Inventor: Robert L. Griggs, Maxim 3 Motel, 4700 W. Fuqua, Houston, Tex. 77045

[21] Appl. No.: 919,623

[22] Filed: Jul. 24, 1992

Related U.S. Application Data

[63] Continuation of Ser. No. 588,290, Sep. 26, 1990, abandoned.

[51] Int. Cl.[5] ..... B63B 1/34

[52] U.S. Cl. ..... 114/84; 114/219

[58] Field of Search ..... 114/67 R, 67 A, 65 R, 114/84, 222, 219, 227, 229

[56] References Cited

U.S. PATENT DOCUMENTS

| | | | |
|---|---|---|---|
| 632,738 | 9/1899 | O'Hara | 114/84 |
| 843,357 | 2/1907 | Partee et al. | 114/84 |
| 942,478 | 12/1909 | Alexander et al. | 114/84 |
| 1,448,180 | 3/1923 | Atwood et al. | 114/84 |
| 1,638,817 | 8/1927 | Atwood | 114/84 |
| 3,585,953 | 6/1971 | Kramer | 114/67 R |

*Primary Examiner*—David M. Mitchell
*Assistant Examiner*—Stephen P. Avila
*Attorney, Agent, or Firm*—Alan R. Thiele

[57] ABSTRACT

A plurality of plate members for covering the outside of a ship's hull includes a base plate for shaping the plate members. The plate members are each coated with an inner and outer rubber resilient surface. Fasteners are used to attach the plate members to the ship's hull.

17 Claims, 3 Drawing Sheets

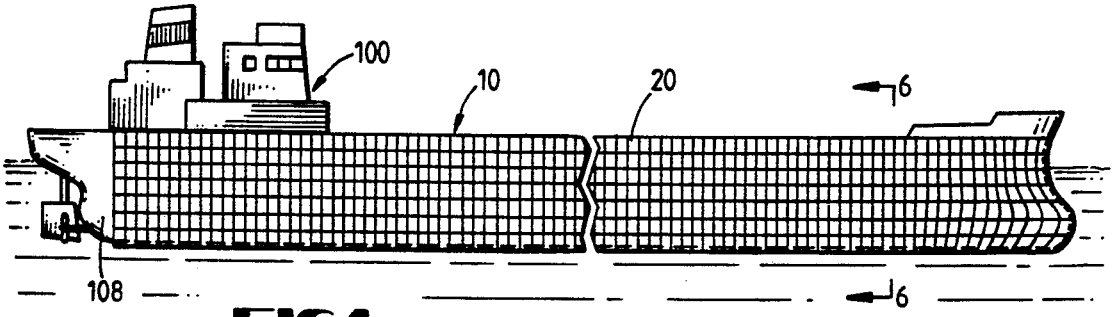
FIG.1
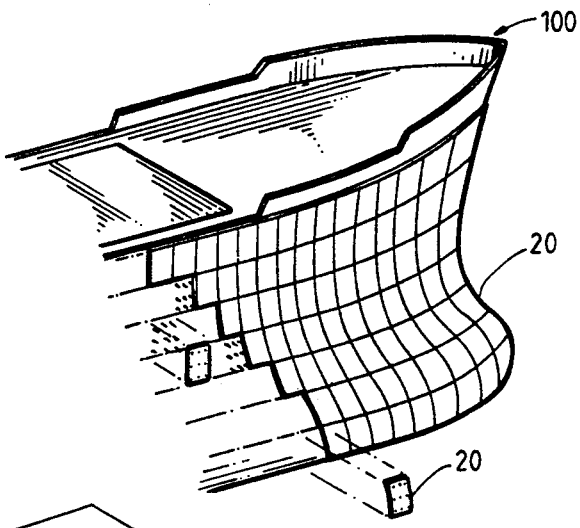
FIG.2
FIG.3
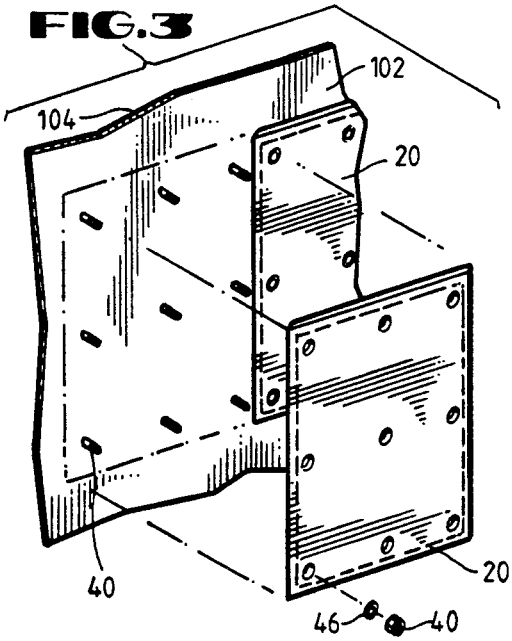
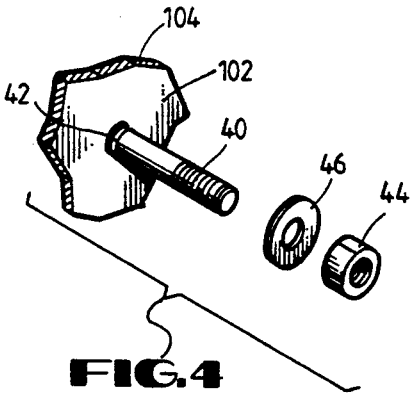
FIG.4

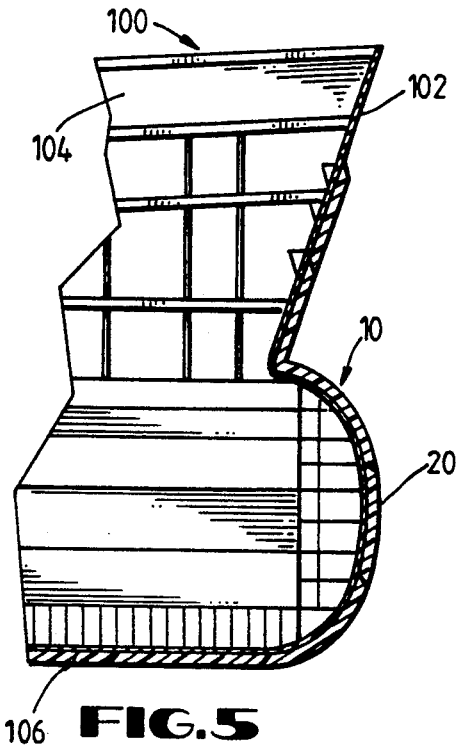
FIG.5
FIG.6
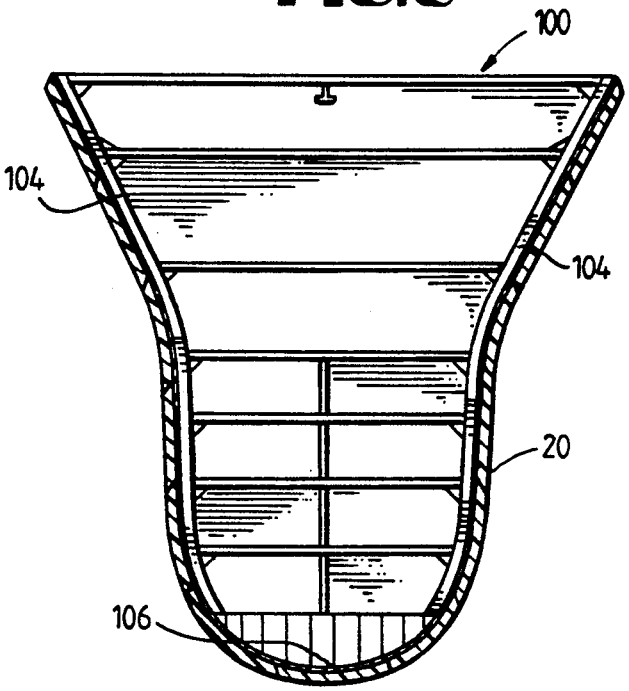
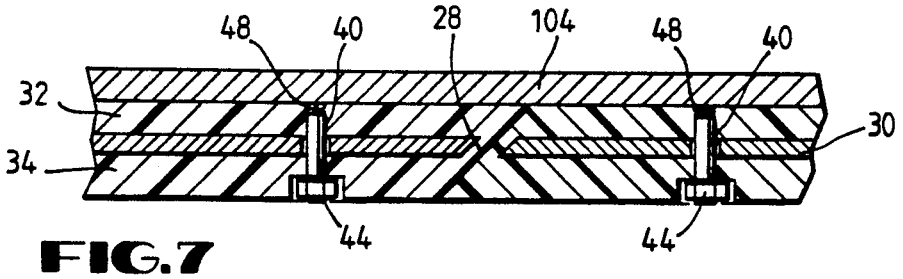
FIG.7
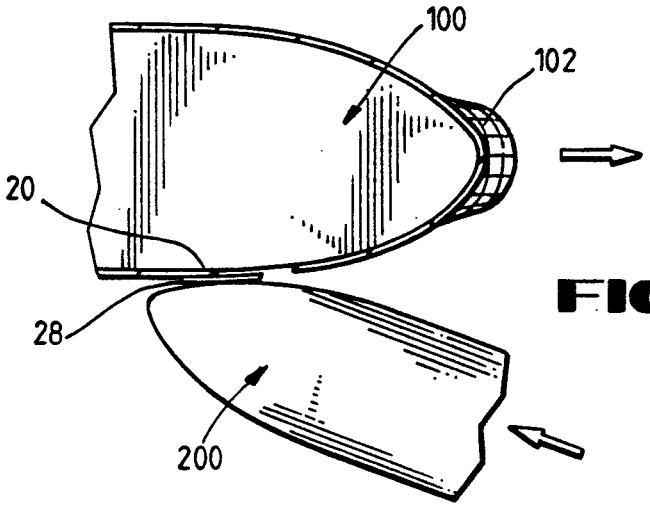
FIG.8

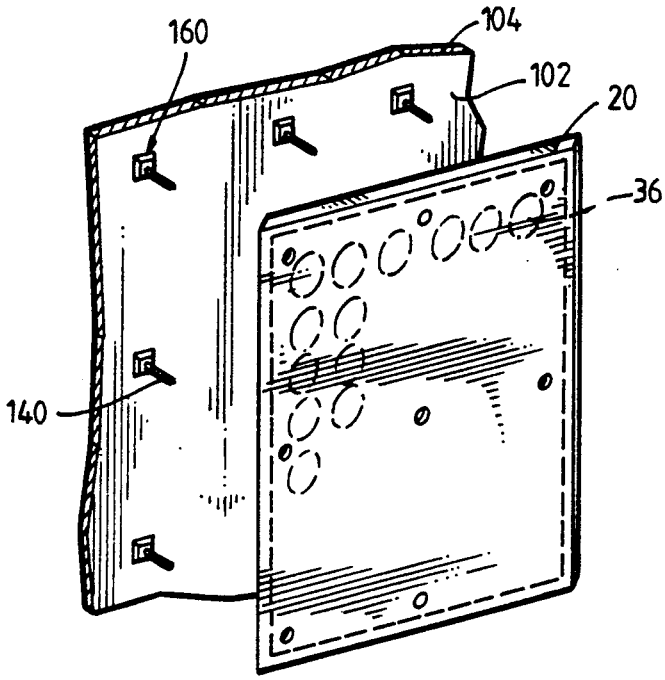
FIG. 9
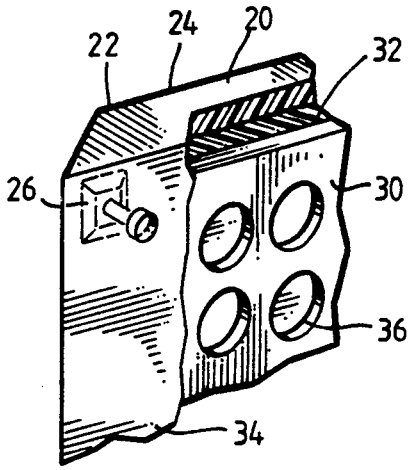
FIG. 10
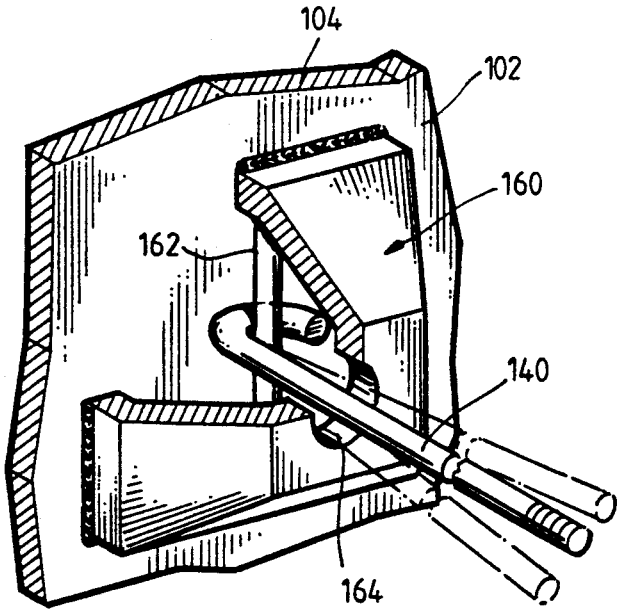
FIG. 11
FIG. 12
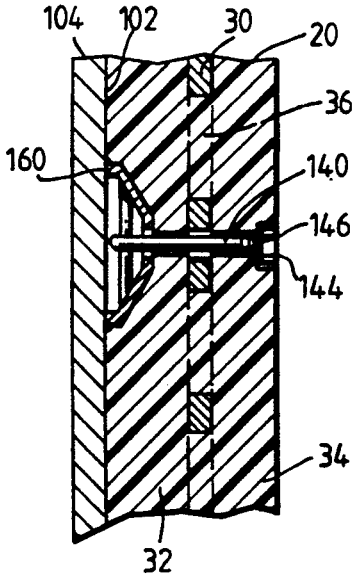

HULL COVERING SYSTEM

This application is a continuation of application Ser. No. 07/588,290, filed Sep. 26, 1990, now abandoned.

BACKGROUND OF THE INVENTION

The present system relates to coverings for the exterior of a ship's hull; more particularly, the present system relates to coverings which protect the exterior of a ship's hull in the event of a collision with another ship or stationary object or a reef on either the port or starboard side.

In recent years, the number of oil spills from tankers has increased dramatically. One of the methods proposed for correcting this problem is to assure that tankers containing products which may pollute the ocean and surrounding beaches have double hulls. Double hulls are extremely expensive to construct and dramatically increase the weight of a ship. This increase in weight correspondingly increases the power required to propel a ship through the water and, thus, increases the shipping costs. Such shipping costs will eventually be passed on to the consumer in the form of higher prices.

There is, therefore, a need in the art to provide a low cost method of protecting the exterior of a ship's hull which does not require the complexities or expense of using a double-hull system. Such system should allow for the dissipation of force over a ship's hull following an impact and, secondly, should also protect the ship's hull and minimize the damage to the ship's hull should the ship be involved in collision with a stationary object or another ship.

SUMMARY OF THE INVENTION

The ship's hull covering system of the present invention allows for the dissipation of force over a ship's hull following an impact and both protects the ship's hull and minimizes hull damage in the event of a collision. Specifically, the ship's hull covering system described herein includes a plurality of plate members which are shaped to conform to the various curves and contours that make up the external surface of a ship's hull. Each individual plate member has a means for shaping the plate member to the various curves and contours of the ship's hull. The plate members also include fasteners for attaching the plate members to the hull. Each plate member has an inner and outer surface. The inner and outer surfaces are made of rubber. To facilitate the mounting of the rubber to the means for shaping the plate member, the plate member includes a plurality of holes in the preferred embodiment.

BRIEF DESCRIPTION OF THE DRAWINGS

A better understanding of the ship's hull covering system of the present invention may be had by reference to the figures wherein:

FIG. 1 is a side elevational view of an ocean-going vessel or ship having the mounting plates of the present invention;

FIG. 2 is a perspective view of the bow portion of a ship illustrating the location of one of the plate members;

FIG. 3 is an exploded view showing the mounting of one of the plate members;

FIG. 4 is an exploded view showing a method of attachment of plate members to the ship's hull;

FIG. 5 is a cross-sectional view of the bow of the vessel shown in FIG. 1;

FIG. 6 is a sectional view taken at line 6—6 of FIG. 1;

FIG. 7 is a sectional view showing the mounting of adjacent plates on the surface of the ship's hull;

FIG. 8 is a schematic representation of the after effect of an impact between two ships wherein one of the ships is coated with the covering system of the present invention;

FIG. 9 is an exploded view showing an alternate method of attachment of plate members to the ship's hull;

FIG. 10 is an enlarged view of one corner of a plate member according to the alternate embodiment;

FIG. 11 is an enlarged view of the attachment points shown in FIG. 9; and FIG. 12 is a cross sectional view of a plate mounted on the ship's hull according to the alternate embodiment.

BRIEF DESCRIPTION OF THE EMBODIMENTS

As may be seen in FIG. 1, the ship's hull covering system 10 of the present invention is designed for use on large ocean going vessels, generally 100; however its usefulness is not limited by the large size of such vessels. In general terms, the system 10 of the present invention includes a plurality of plates, generally 20, which are individually shaped to fit on the external surface of a large ship 100 such as a tanker.

As may be seen by reference to FIG. 2, in actual practice the system is made up of many plates 20. Each has a specific location with regard to the ship's hull. Those of ordinary skill in the art will understand that it may be possible to code each and every plate with a certain number which corresponds to its location on the exterior of a ship's hull. A similar system is used on the underside of the shuttle spacecraft for the location of the various ceramic tiles which form a heat shield to protect the underside of the space shuttle on re-entry into the earth's atmosphere.

As may be seen in FIG. 3, the various plates 20 which make up the system 10 of the present invention are attached to the outside 102 of the ship's hull 104 by a plurality of fasteners, generally 40. As may be seen in FIG. 4, such fasteners 40 may be threaded fasteners which are welded 42 to the outside 102 of the ship's hull 104. In this system, the plate members 20 are attached to the fasteners 40 with nuts 44 and washers 46. In the alternative, other mounting systems may be used. Such other mounting systems may include rivets, pins or the like. An exemplary alternative mounting system is shown in FIGS. 9–12.

Referring specifically to FIG. 9–12, it may be seen that "J" bolts 140 are passed through openings 22 in the plates 20 and are hooked onto eye pieces, generally 160, attached to the ship's hull.

In the preferred embodiment, eye pieces 160 include an internal bar 162 to which "J" bolt 140 is attached. It will be understood by those of ordinary skill in the art that the "J" bolt 140 may be used without bar 162 or a large headed bolt may be used in place of "J" bolt 140. Hole 164 allows "J" bolt 140 to pass out of eye piece 160. In the embodiment illustrated, eye piece 160 has been formed in a frusto-pyramid shape. It will be understood by those of ordinary skill in the art that a variety of shapes such as frusto-conical, cylindrical, rectangular, etc. without departing from the scope of the invention. As shown in FIG. 12, nuts 144 and washers 146 may be used to hold plate 20 against the outside 02 of ship's hull 104. As may be seen in FIG. 11, this system has the advantage of allowing for inexact placement of plates 20.

When the system shown in FIGS. 9–12 is used, it may be desirable to recess eye pieces 160 into the back surface 24 of plates 20. To accomplish this, a shaped recess 26 is formed to accommodate eye piece 160.

As may be seen in FIGS. 5 and 6, the system, once mounted on a ship 100, is designed to cover the bow 102, sides 104 and bottom 106 of the ship 100. As may be seen by further reference to FIG. 1, the covering system 10 may extend all the way to the stern 108 of ship 100. It has been found that there is no specific need to cover the rear portion 108 of a ship 100 as the system 10 is designed primarily to protect the ship 100 against impact with fixed objects or collision with other ships. The purpose of the system disclosed herein is to protect those portions of the ship most vulnerable to damage on impact.

As may be seen in FIG. 7, the various plate members 20 are attached to the ship's hull 104 by threaded fasteners 40 as shown in FIG. 4. The plate members 20 also are formed to include beveled edges 28. These beveled edges 28 assist the plates 20 in sliding, one over another, as shown in FIG. 8 should an impact with another ship 200 or a fixed object occur. Specifically, the plates 20 in the more forward 102 portion will slide over the plates 20 in the more aft portion. In the preferred embodiment, the fasteners as shown in FIG. 4 include a shearable or weakened portion 48 which severs should the ship 100 impact another ship 200 or a fixed object. Such shearable property may also be included in "J" bolt 140. Once the fasteners 40 break, the plates 20 will be allowed to move in a sliding fashion. The energy to be dissipated following the impact will cause the plates 20 to move rather than destroying the hull 104.

As may be further seen by reference to FIGS. 7, 10 and 12, each plate 20 consists of a central or core portion 30. The central or core portion 30 is shaped to match a certain section on the hull 104 of the ship 100. On both sides of the central or core portion 30 is a covering of resilient rubber 32 and 34. It has been found that a hard rubber such as that used on tanktreads may be used. Other rubbers of similar hardness and consistencies may also be used without departing from the scope of the invention.

As shown in FIGS. 9, 10 and 12, the central or core portion of the plate 30 may include a plurality of holes 36. It has been found that by utilizing a plurality of holes 36 the rubber may flow through holes 36 while the plate member 20 is being formed. The central or core portion 30 may be formed from an expanded metal such as used in grates or, in the alternative, it may be a metallic mesh. The chief requirement is that the central or core portion 30 be shaped so as to give the plate 20 the required shape to be mounted on the exterior 102 of the vessel 100.

In the event of an impact as shown in FIG. 8, the weakened portion 48 of fasteners 40 shown in FIG. 4 will shear. It may then be necessary to replace the various plates 20 on the exterior 102 of the ship 100 before the ship 100 is returned to sea. It is envisioned that the dimensions, curves and contours of each plate 20 will be retained in a central location. Should additional plates 20 be necessary, the plates 20 should be sized so as they may be easily placed in a cargo aircraft and shipped to the location where the ship 100 may be in dry dock for repairs. The replacement plate 20 would then be transferred to the ship 100 by ground transportation and mounted thereon before the ship 100 returns to sea.

In the preferred embodiment it has been found that the thickness of each plate 20 should be between three and six inches.

There has been provided by the system 10 of the present invention a method for both distributing the impact forces on a ship's hull 104 in the event of a collision and covering the outside of a ship's hull 104.

It will be understood by those of ordinary skill in the art that numerous modifications may be made to the system as disclosed in the foregoing specification and appended claims. Such modifications shall fall within the scope of the appended claims.

I claim:

1. A ship's hull covering system comprising:
   a plurality of individually removable plate members constructed and arranged to conform to the various contours of the ship's hull, said individually removable plate members including:
   a metal plate having a plurality of holes for shaping said individually removable plate members;
   an inner-resilient surface formed on said metal plate;
   an outer-resilient surface formed on said metal plate; beveled edges;
   a plurality of severable support members constructed and arranged to attach said individually removable plate members to the exterior of the ship's hull;
   whereby, in the event of an impact, those individually removable plate members in the more forward portion of the ship's hull may slide up and over the individually removable plate members in the more rearward portion of the ship's hull.

2. The system as defined in claim 1 wherein said metal plate is formed of expanded metal.

3. The system as defined in claim 1 wherein said metal plate is a metallic mesh.

4. The system as defined in claim 1 wherein said inner and outer resilient surfaces are made from rubber.

5. The system as defined in claim 1 wherein said severable support members are threaded fasteners.

6. The system as defined in claim 1 wherein said severable support members are pins.

7. The system as defined in claim 1 wherein said individually removable plate members are constructed and arranged to be transportable within the cargo portion of an aircraft.

8. The system as defined in claim 1 wherein said individually removable plate members have a thickness of between three and six inches.

9. A method for protecting the hull of a ship, said method comprising the steps:
   dividing the exterior surface of the ship's hull into discrete areas;
   forming a plurality of individually removable protective plate members to cover each of said discrete areas, said individually removable protective plate members having:
   a metal plate having a plurality of holes for shaping said individually removable protective plate members;
   an inner-resilient surface formed on said metal plate;
   an outer-resilient surface formed on said metal plate;
   severable means for attaching said individually removable protective plate members to the ship's hull;

whereby, in the event of an impact, those individually removable plate members in the more forward portion of the ship's hull may slide up and over the individually removable plate members in the more rearward portion of the ship's hull.

10. The method as defined in claim 9 further including attaching said individually removable protective plate members to said ship's hull with severable threaded fasteners.

11. The method as defined in claim 9 wherein said individually removable protective plate members include beveled edges.

12. The method as defined in claim 9 wherein said inner and outer resilient surfaces are made from rubber.

13. The method as defined in claim 10 wherein said severable fasteners are pins.

14. A ship's hull covering system comprising:

a plurality of individual removable plate members having:

a base member constructed and arranged to match the contour of a discrete area on the ship's hull, said base member having:

a plurality of holes therethrough;

a covering of resilient rubber formed on either side of said base member;

beveled edges;

a plurality of severable fasteners constructed and arranged to affix the individually removable plate members to corresponding discrete areas on the ship's hull;

whereby, in the event of an impact, those individually removable plate members in the more forward portion of the ship's hull may slide up and over the individually removable plate members in the more rearward portion of the ship's hull.

15. The system as defined in claim 14 wherein said individually removable plate members are formed by causing said resilient rubber to pass through holes in said base member.

16. The system as defined in claim 15 wherein said resilient rubber has a thickness of between three and six inches.

17. The system as defined in claim 16 further including a plurality of eye pieces attached to the hull of the ship.

* * * * *